US008394213B2

(12) United States Patent
Meurer et al.

(10) Patent No.: US 8,394,213 B2
(45) Date of Patent: Mar. 12, 2013

(54) PROCESS FOR COATING A HOT- OR COLD-ROLLED STEEL STRIP CONTAINING 6–30% BY WEIGHT OF MN WITH A METALLIC PROTECTIVE LAYER

(75) Inventors: Manfred Meurer, Rheinberg (DE); Ronny Leuschner, Dresden (DE); Harald Hofmann, Dortmund (DE)

(73) Assignee: ThyssenKrupp Steel AG, Duisburg (DE)

( * ) Notice: Subject to any disclaimer, the term of this patent is extended or adjusted under 35 U.S.C. 154(b) by 0 days.

(21) Appl. No.: 12/377,323

(22) PCT Filed: Aug. 20, 2007

(86) PCT No.: PCT/EP2007/058602

§ 371 (c)(1), (2), (4) Date: Jun. 22, 2009

(87) PCT Pub. No.: WO2008/022980

PCT Pub. Date: Feb. 28, 2008

(65) Prior Publication Data

US 2010/0065160 A1 Mar. 18, 2010

(30) Foreign Application Priority Data

Aug. 22, 2006 (DE) ..... 10 2006 039 307

(51) Int. Cl.
*C21D 8/02* (2006.01)

(52) U.S. Cl. ..... 148/530; 148/533; 148/537

(58) Field of Classification Search ..... 148/547, 148/620, 651, 530, 533, 537
See application file for complete search history.

(56) References Cited

U.S. PATENT DOCUMENTS

| | | | | |
|---|---|---|---|---|
| 5,041,166 | A * | 8/1991 | Matsuoka et al. | 148/651 |
| 6,358,338 | B1 * | 3/2002 | Guelton et al. | 148/547 |
| 6,610,422 | B1 * | 8/2003 | Ooi et al. | 428/653 |
| 2006/0292391 | A1 | 12/2006 | Ikematsu et al. | 428/659 |
| 2007/0051438 | A1 | 3/2007 | Honda et al. | 148/533 |
| 2008/0053580 | A1 * | 3/2008 | Drillet et al. | 148/620 |
| 2008/0271823 | A1 | 11/2008 | Hofmann et al. | 148/531 |

FOREIGN PATENT DOCUMENTS

| | | |
|---|---|---|
| BE | 1011131 | 5/1999 |
| DE | 197 27 759 | 1/1999 |
| DE | 199 00 199 | 7/2000 |
| DE | 102 59 230 | 7/2004 |
| DE | 10 2005 008 410 | 2/2006 |

(Continued)

OTHER PUBLICATIONS

International Search Report for International Application No. PCT/EP2007/058602.

*Primary Examiner* — Weiping Zhu
(74) *Attorney, Agent, or Firm* — The Webb Law Firm

(57) ABSTRACT

A method for coating hot-rolled or cold-rolled steel strip containing 6-30 wt %. Mn with a metallic protective layer, includes annealing the steel strip at a temperature of 800-1100° C. under an annealing atmosphere containing nitrogen, water and hydrogen and then subjecting the steel strip to hot dip coating. The method provide an economical way of hot dip coating a high manganiferous sheet steel in that, in order to produce a metallic protective layer substantially free from oxidic sub-layers on the steel strip, the % $H_2O$/% $H_2$ ratio of the water content % $H_2O$ to the hydrogen content % $H_2$ in the annealing atmosphere is adjusted as a function of the respective annealing temperature TG as follows: % $H_2O$/% $H_2 \leqq 8 \cdot 10^{-15} \cdot T_G^{3.529}$.

15 Claims, 2 Drawing Sheets

FOREIGN PATENT DOCUMENTS

| | | | |
|---|---|---|---|
| EP | 1612288 | | 1/2006 |
| FR | 2876708 | A1 * | 4/2006 |
| JP | 07-216524 | | 8/1995 |
| WO | 2005/017214 | | 2/2005 |
| WO | 2006/042931 | | 4/2006 |
| WO | 2006042930 | A1 | 4/2006 |

* cited by examiner

PROCESS FOR COATING A HOT- OR COLD-ROLLED STEEL STRIP CONTAINING 6–30% BY WEIGHT OF MN WITH A METALLIC PROTECTIVE LAYER

CROSS-REFERENCE TO RELATED APPLICATIONS

This application is a National Phase Application of International Application No. PCT/EP2007/058602, filed on Aug. 20, 2007, which claims the benefit of and priority to German patent application no. DE 10 2006 039 307.4-45, filed on Aug. 22, 2006. The disclosures of the above applications are incorporated herein by reference in their entirety.

FIELD OF THE INVENTION

The invention relates to a method for coating a hot-rolled or cold-rolled steel strip containing 6-30 wt %. Mn with a metallic protective layer, in particular a protective layer based on zinc, wherein the steel strip to be coated is annealed at a temperature of 800-1100° C. under an annealing atmosphere containing nitrogen, water and hydrogen and is then subjected to hot dip coating.

BACKGROUND

Steels with a high manganese content, due to their advantageous characteristic combination of high strength of up to 1,400 MPa on the one hand and extremely high elongations (uniform elongations up to 70% and elongations at break up to 90%) on the other hand, are basically suitable to a special degree for use within the vehicle industry, particularly car manufacturing. Steels, particularly suitable for this specific application, with high Mn-content of 6 wt %.-30 wt %. are known for example from DE 102 59 230 A1, DE 197 27 759 C2 or DE 199 00 199 A1. Flat products fabricated from the known steels have isotropic deformation behavior with high strength and in addition are also still ductile at low temperatures.

However, counteracting these advantages, steels with a high manganese content are susceptible to pitting corrosion and can only be passivated with difficulty. This large propensity, compared to lower alloyed steel, to locally limited but intensive corrosion with the impact of increased chloride ion concentrations makes it difficult to use steels belonging to the material group of highly alloyed sheet steel especially in car body construction. In addition, steels with a high manganese content are susceptible to surface corrosion, which likewise limits the spectrum of their use.

Therefore, it has been proposed to also provide flat steel products, which are fabricated from steel with a high manganese content, with a metallic coating in the way known per se, which protects the steel against corrosive attack. For this purpose, attempts have been made to apply a zinc coating to the steel material electrolytically.

Although the high manganese-alloyed steel strips, coated in this way, are protected against corrosion by the metallic coating applied thereto, electrolytic coating required for this is a relatively costly operation in terms of process-engineering. In addition, there is a risk of hydrogen absorption, which is harmful to the material.

Practical attempts to provide steel strips having a high manganese content with a metallic protective layer through more economically feasible, practicable hot dip coating, apart from the fundamental problems in wetting with the hot metal, particularly as regards adhesion of the coating to the steel substrate, required in the case of cold forming, brought unsatisfactory results.

The thick oxide layer, which arises from the annealing essential to hot dip coating, was found to be the reason for these poor adhesion characteristics. The sheet metal surfaces, oxidized in such a manner, can no longer be wetted by the metallic coating to the necessary degree of uniformity and entirety, so that the aim of total surface area corrosion protection cannot be achieved.

The possibilities, known from the spectrum of steels, highly alloyed but having lower Mn-contents, of improving wettability by applying an intermediate layer of Fe or Ni in the case of sheet steel comprising at least 6 wt %. manganese have not led to the desired success.

In DE 10 2005 008 410 B3 the application of an aluminum layer to a steel strip containing 6-30 wt %. Mn before final annealing prior to hot dip coating was proposed. The aluminum adhering to the steel strip during annealing before hot dip coating of the steel strip prevents its surface from oxidizing. Subsequently, the aluminum layer, as a kind of adhesion promoter, causes the layer produced by the hot dip coating to adhere firmly over the total surface area of the steel strip, even if the steel strip itself, due to its alloying, presents disadvantageous conditions for this. In the case of the known method, the effect during the annealing treatment essential before hot dip coating, of iron diffusing from the steel strip into the aluminum layer, is exploited for this purpose so that in the course of annealing a metallic deposit, substantially consisting of Al and Fe forms on the steel strip, which then bonds intimately with the substrate formed by the steel strip.

Another method for coating high manganiferous steel strip containing by wt %. 0.35-1.05% C, 16-25% Mn, remainder iron as well as unavoidable impurities, is known from WO 2006/042931 A1. In accordance with this known method the steel strip composed in such a way is first cold-rolled and then being subjected to re-crystallisation annealing in an atmosphere, which is reducing in relation to iron. The annealing parameters are selected such that said steel strip is covered on both faces with a sub-layer which is essentially completely amorphous oxide (FeMn)O and additionally with an outer layer of crystalline manganese oxide, the thickness of the two layers being at least 0.5 μm. Investigations have shown that, in practice, steel strip elaborately pre-coated in such a manner also does not have the adhesion to the steel substrate required for cold forming.

As well as the prior art described above, a method for hot-dip coating hot-rolled steel plate, which possesses high tensile strength, is known from the JP 07-216524 A. In the course of this known method the steel plate is first de-scaled, pickled and cleaned. Then it is weakly oxidized in order to produce an iron oxide film, which has a thickness of 500-10,000 Å, thereon. This iron oxide film is subsequently reduced by reduction heating to active metallic iron. The reduction heating is carried out such that selective oxidation of Si and Mn in the steel and concentration of these elements on the surface are avoided. For this purpose, reduction heating is carried out under an atmosphere, whose hydrogen concentration is regulated in the range of 3-25% vol. so that on the one hand it has sufficient reduction capacity for reducing the iron oxide, on the other hand, however, the selective oxidation of Si and Mn does not happen.

SUMMARY OF THE INVENTION

In general, an aspect of the invention includes providing a method, with which sheet steel with a high manganese content can be economically hot dip coated.

The method of the type described above, in order to produce a metallic protective layer, substantially free from oxidic sub-layers, the % $H_2O$/% $H_2$ ratio of the water content % $H_2O$ to the hydrogen content % $H_2$ in the annealing atmosphere is adjusted as a function of the respective annealing temperature TG as follows:

$$\% H_2O/\% H_2 < 8 \cdot 10^{-15} \cdot T_G^{3.529}$$

In taking this % $H_2O$/% $H_2$ ratio into consideration, an optimum working result can be ensured over the entire range of the annealing temperatures $T_G$ in question.

The invention is based on the realization that as the result of suitably adjusting the annealing atmosphere, that is to say, the ratio of its hydrogen content to its water content as well as its dew point, annealing leads to a surface finish of the steel strip to be coated, which provides optimum adhesion of the metallic protective layer applied subsequently by hot dip coating. In this case the annealing atmosphere adjusted according to the invention is reducing in relation to both the iron as well as the manganese in the steel strip. In contrast to the prior art described in WO 2006/042931 A1 for example, according to the invention, the formation of an oxide layer, impairing the adhesion of the hot dip coating to the high manganiferous steel substrate, is thus avoided in a controlled manner. In this way, high strength and at the same time ductile steel strip provided with a metallic coating is obtained as a result, wherein superior adhesion is provided despite the high manganese content. This enables steel strip coated according to the invention to be converted without difficulty into pressed parts, as they are regularly required for bodywork construction, particularly in the car industry.

Typical annealing temperatures applied in a process according to the invention lie in the range of 800-1100° C. The % $H_2O$/% $H_2$ ratio according to the invention should lie below $4.5 \cdot 10^4$ over the entire range of these annealing temperatures in each case.

By also reducing the % $H_2O$/% $H_2$ ratio corresponding to the relation specified according to the invention together with a lower annealing temperature, optimum working results can be achieved. Practical trials have shown that the success of the invention, with an annealing temperature of 850° C., is particularly reliably ensured if the % $H_2O$/% $H_2$-ratio is limited to $2 \cdot 10^{-4}$. With an annealing temperature of 950° C., particularly good operational reliability results if the % $H_2O$/% $H_2$ ratio is a maximum of $2.5 \cdot 10^{-4}$. The % $H_2O$/% $H_2$ ratio can be decreased by raising the $H_2$ content or by lowering the $H_2O$ content of the atmospheric gas.

If the steel strip processed according to the invention is cold-rolled in one or more stages, the steel strip can be annealed during the intermediate annealing stages carried out between the individual cold-rolling steps or during annealing carried out following cold-rolling, in order to prepare for the hot dip coating under the annealing atmosphere adjusted according to the invention.

Alternatively or in addition thereto, the annealing and hot dip coating can be carried out in a continuous operation. This way of applying the method according to the invention is particularly suitable if coating takes place in a conventional coil-coating installation, wherein an annealing furnace and the hot metal dip-tank are arranged in-line in the usual way and the steel strips run through continuously one after the other in uninterrupted succession.

The method according to the invention is suitable for hot dip coating of high manganiferous steel strips with a layer consisting essentially totally of Zn and unavoidable impurities (so-called "Z-coating"), with a zinc-iron layer, which includes up to 92 wt %. Zn and up to 12 wt %. Fe (so-called "ZF-coating"), with an aluminum-zinc layer, whose Al-content is up to 60 wt %. and whose Zn-content is up to 50 wt % (so-called "AZ-coating"), with an aluminum-silicon layer, which has an Al content of up to 92 wt %. and an Si-content of up to 12 wt % (so-called "AS-coating"), with a zinc-aluminum layer, which has a content of up to 10 wt %. Al, remainder zinc and unavoidable impurities (so-called "ZA-coating") or with a zinc-magnesium layer, which has a Zn-content of up to 99.5 wt %. and a Mg-content of up to 5 wt %. (so-called "ZnMg-coating") as well as in addition optionally containing up to 11 wt %. Al, up to 4 wt %. Fe and up to 2 wt %. Si.

The coating procedure according to the invention is particularly suitable for such steel strips, which are highly alloyed, in order to guarantee high strength and good elongation properties. The steel strips, which can be provided with a metallic protective layer by hot dip coating according to the invention, thus typically contain (in wt %.)

C: ≦1.6%, Mn 6-30%, Al: ≦10%, Ni: ≦10%, Cr: ≦10%, Si: ≦8%, Cu: ≦3%, Nb: ≦0.6%, Ti: ≦0.3%, V: ≦0.3%, P: ≦0.1%, B: ≦0.01%, N: ≦1.0%, remainder iron and unavoidable impurities.

The effects obtained by the invention work particularly advantageously when highly alloyed steel strips, which contain manganese of at least 6 wt %., are coated. Thus, it is shown that a basic steel material, which contains (in wt %.)

C: ≦1.00%, Mn: 20.0-30.0%, Al: ≦0.5%, Si: ≦0.5%, B: ≦0.01%, Ni: ≦3.0%, Cr: ≦10.0%, Cu: ≦3.0%, N: ≦0.6%, Nb: ≦0.3%, Ti: ≦0.3%, V: ≦0.3%, P: ≦0.1%, remainder iron and unavoidable impurities, can be coated particularly well with a layer to protect against corrosion.

The same applies if a steel is used as the base material, which contains (in wt %.)

C: ≦1.00%, Mn: 7.00-30.00%, Al: 1.00-10.00%, Si: >2.50-8.00% (where the sum of Al-content and Si-content is >3.50-12.00%), B: <0.01%, Ni: <8.00%, Cu: <3.00%, N: <0.60%, Nb: <0.30%, Ti: <0.30%, V: <0.30%, P: <0.01%, remainder iron and unavoidable impurities.

The invention provides an economical way to protect high manganiferous steel strips against corrosion so that they can be used to produce bodies for the manufacture of vehicles, especially cars, during the practical use of which they are particularly exposed to corrosive media.

As with usual hot dip coating, both hot-rolled and cold-rolled steel strips can be coated according to the invention.

BRIEF DESCRIPTION OF THE DRAWINGS

The invention is described below in detail on the basis of a drawing illustrating an exemplary embodiment. There is illustrated schematically in each case.

DETAILED DESCRIPTION

In three trial series V1, V2, V3 three high-strength, high manganiferous steels S1, S2, S3, whose composition is indicated in table 1, were cast into slabs and rolled to hot strip. The hot-rolled strip obtained in each case was subsequently cold-rolled to final thickness and conveyed to a conventional hot dip coating installation.

In the hot dip coating installation the steel strips were first cleaned and subsequently, in a continuous annealing process, were brought to the respective annealing temperature TG, at which they were held over an annealing time ZG of 30 seconds in each case under a hydrogen-containing annealing atmosphere adjusted according to the invention.

After the annealing treatment the annealed steel strips were cooled down in each case to a dip-tank entry temperature of 470° C. and taken in a continuous operation through a 460° C. hot zinc dip-tank, which consisted of 0.2% Al and remainder Zn and unavoidable impurities. After withdrawal from the hot zinc dip-tank in the way known per se, the thickness of the Zn-protective coating on the steel strip was adjusted by a jet stripping system.

In large scale industrial production, following hot dip coating and adjustment of the layer thickness, the steel strip can be re-rolled if necessary, in order to adapt the dimensional accuracy of the strip obtained, its forming behavior or its surface finish to the respective requirements. Finally, the steel strip, provided with the coating, can be oiled for transport to the end user and wound into a coil.

The trial series V1 comprised five trials V1.1-V1.5 with a steel strip produced from the steel S1. In the course of the trial series V2 seven trials V2.1-V2.7 were carried out with a steel strip produced from the steel S2. In the case of the trial series V3 eleven trials were finally carried out with a steel strip produced from the steel S3.

The annealing temperature $T_G$ used in each case in the aforementioned trial series, the respective $H_2$ content % $H_2$ of the annealing atmosphere, its respective dew point TP, the respective $H_2O$ content % $H_2O$, the % $H_2O$/% $H_2$ ratio as well as an evaluation of the coating obtained and allocation of the test results as "according to the invention" or "not according to the invention" are indicated for the trial series V1 in table 2 and for the trial series V2 in table 3 and for the trial series V3 in table 4.

Figure 5:
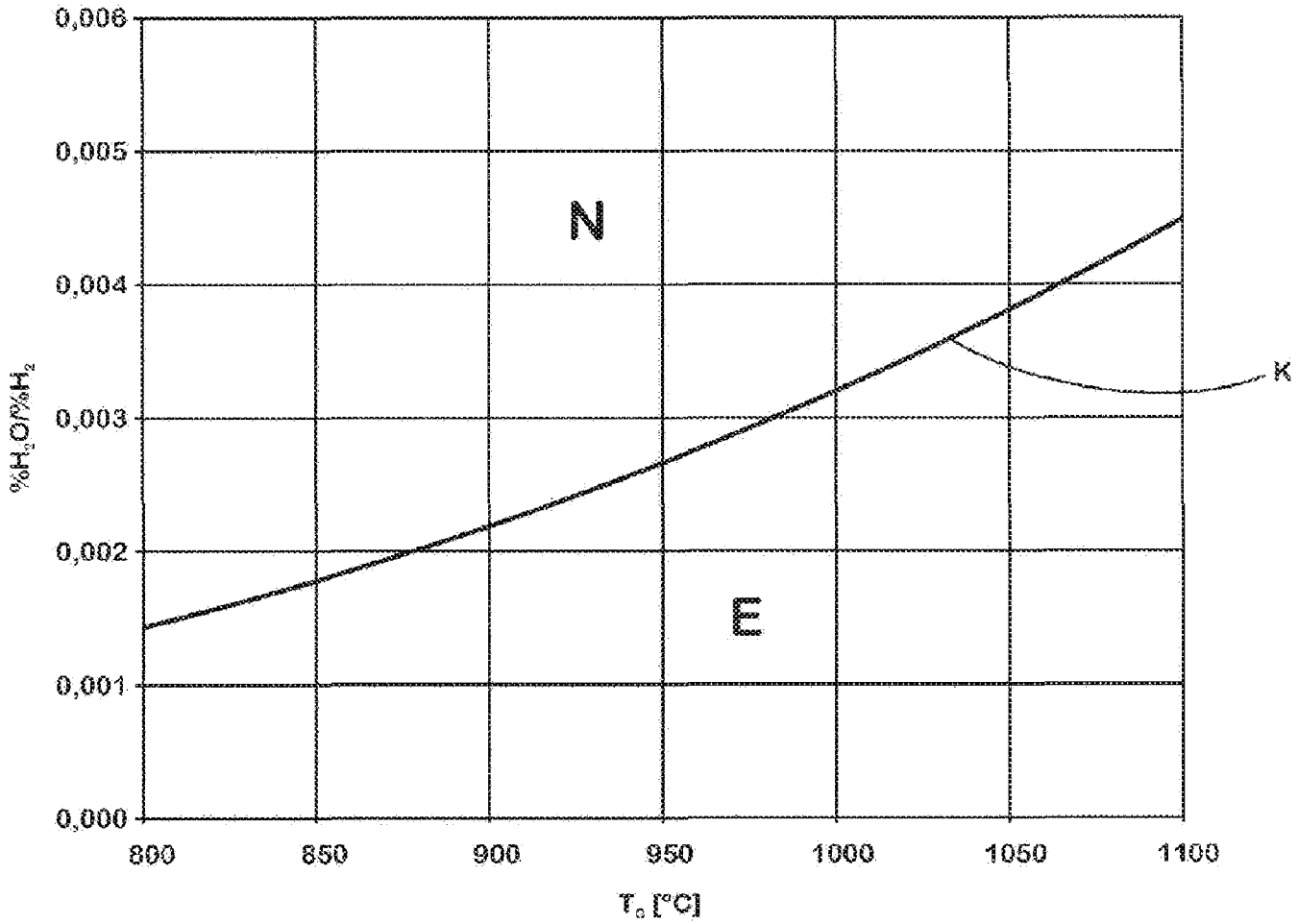
FIG. 5 the % $H_2O$/% $H_2$ ratio of the water content % $H_2O$ to the hydrogen content % $H_2$ in the annealing atmosphere plotted over the annealing temperature TG as a function thereof.

In FIG. 5 the % $H_2O$/% $H_2$ ratio is plotted over the annealing temperature TG. In this case, the area "E", located below a curve K, in which the % $H_2O$/% $H_2$ ratios adhered to lie according to the condition:

$$\% H_2O/\% H_2 \leqq 8 \cdot 10^{-15} \cdot T_G^{3.529}$$

in the case of the annealing atmosphere adjusted according to the invention, is separated from the area "N" located above the curve K, in which the % $H_2O$/% $H_2$ ratios of an atmosphere not adjusted according to the invention are found.

Figure 1:
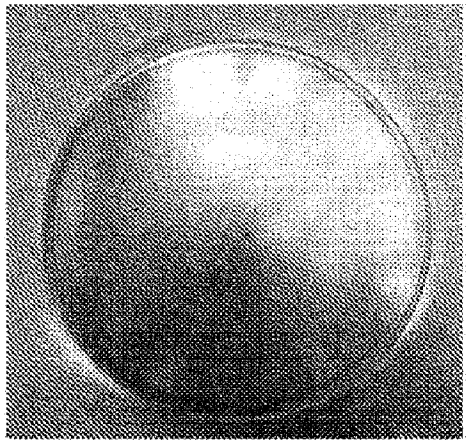
FIG. 1 a photograph of a steel sheet provided in the way method according to the invention with a zinc coating following a ball impact test.

FIG. 1 shows the result of a ball impact test, which was carried out on the steel sheet provided with the Zn-protective coating obtained in the trial V1.4. The perfect adhesion of the coating, also in the most deformed area of the calotte formed in the steel sheet, can be clearly seen.

Figure 2:
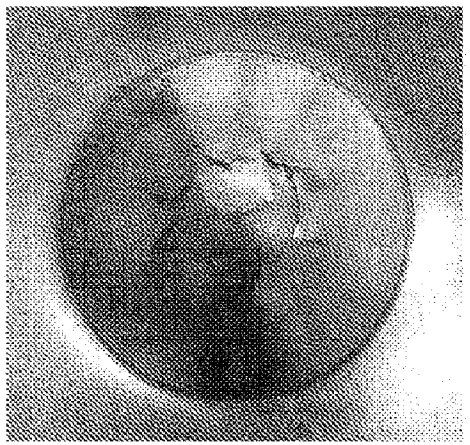
FIG. 2 a photograph of a steel sheet provided for comparison in a way deviating from the invention with a zinc coating following a ball impact test.

FIG. 2 shows the result of a ball impact test, which was carried out on the steel sheet obtained in the trial V1.1. Flaking of the coating in the area of the calotte formed in the steel sheet can be clearly recognized.

Figure 3:
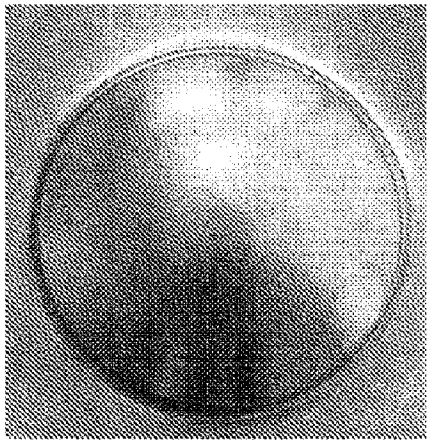
FIG. 3 a photograph of a second steel sheet provided in the way method according to the invention with a zinc coating following a ball impact test.

FIG. 3 shows the result of a ball impact test, which was carried out on the steel sheet obtained in the trial V1.5. Also, with this specimen coated according to the invention, the coating adheres perfectly well over the entire calotte formed in the steel sheet.

Figure 4:
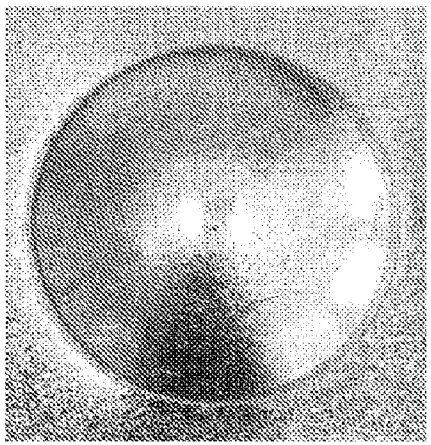
FIG. 4 a photograph of a second steel sheet provided for comparison in a way deviating from the invention with a zinc coating following a ball impact test.

FIG. 4 finally shows the result of a ball impact test, which was carried out on the steel sheet coated in the trial V1.2. The unsatisfactory adhesion of the coating on the steel substrate is shown by the cracks in the most deformed area of the calotte formed in the steel sheet.

TABLE 1

| Steel | C | Si | Mn | P | Cr | Ni | V |
|---|---|---|---|---|---|---|---|
| S1 | 0.60 | 0.28 | 22.5 | 0.021 | 0.003 | 0.077 | 0.006 |
| S2 | 0.63 | 0.20 | 22.2 | 0.014 | 0.130 | 0.046 | 0.200 |
| S3 | 0.62 | 0.30 | 22.5 | 0.018 | 0.600 | 0.170 | 0.300 |

Details in wt %., remainder iron and unavoidable impurities

TABLE 2

| Trial | $T_G$ [° C.] | % $H_2$ [%] | TP [° C.] | % $H_2O$ [%] | % $H_2O$/% $H_2$ | Evaluation of zinc coating | According to invention |
|---|---|---|---|---|---|---|---|
| V1.1 | 850 | 50 | −31 | 0.03375 | 0.0006750 | Poor | No |
| V1.2 | 850 | 100 | −30 | 0.03747 | 0.0003747 | Poor | No |
| V1.3 | 900 | 50 | −38 | 0.01584 | 0.0003168 | Poor | No |
| V1.4 | 950 | 50 | −46 | 0.00630 | 0.0001260 | Good | Yes |
| V1.5 | 950 | 100 | −34 | 0.02454 | 0.0002454 | Good | Yes |

TABLE 3

| Trial | $T_G$ [° C.] | % $H_2$ [%] | TP [° C.] | % $H_2O$ [%] | % $H_2O$/% $H_2$ | Evaluation of zinc coating | According to invention |
|---|---|---|---|---|---|---|---|
| V2.1 | 850 | 50 | −40 | 0.01266 | 0.0002532 | Poor | No |
| V2.2 | 850 | 100 | −42 | 0.01007 | 0.0001007 | Good | Yes |
| V2.3 | 900 | 50 | −41 | 0.01130 | 0.0002260 | Poor | No |
| V2.4 | 950 | 50 | −42 | 0.01007 | 0.0002014 | Good | Yes |
| V2.5 | 950 | 100 | −42 | 0.01007 | 0.0001007 | Good | Yes |
| V2.6 | 800 | 5 | −60 | 0.00106 | 0.0002119 | Poor | No |
| V2.7 | 800 | 5 | −70 | 0.00025 | 0.0000509 | Good | Yes |

TABLE 4

| Trial | $T_G$ [° C.] | % $H_2$ [%] | TP [° C.] | % $H_2O$ [%] | % $H_2O$/% $H_2$ | Evaluation of zinc coating | According to invention |
|---|---|---|---|---|---|---|---|
| V3.1 | 950 | 50 | −56 | 0.00181 | 0.0000362 | Good | Yes |
| V3.2 | 950 | 50 | −56 | 0.00181 | 0.0000774 | Good | Yes |
| V3.3 | 950 | 50 | −47 | 0.00559 | 0.0001118 | Good | Yes |
| V3.4 | 950 | 50 | −44 | 0.00798 | 0.0001596 | Good | Yes |
| V3.5 | 950 | 50 | −53 | 0.00266 | 0.0000532 | Good | Yes |
| V3.6 | 850 | 50 | −53 | 0.00266 | 0.0000532 | Good | Yes |
| V3.7 | 850 | 50 | −49 | 0.00438 | 0.0000876 | Good | Yes |
| V3.8 | 850 | 50 | −42 | 0.01007 | 0.0002014 | Poor | No |

TABLE 4-continued

| Trial | $T_G$ [° C.] | % $H_2$ [%] | TP [° C.] | % $H_2O$ [%] | % $H_2O$/% $H_2$ | Evaluation of zinc coating | According to invention |
|---|---|---|---|---|---|---|---|
| V3.9 | 1100 | 5 | −34 | 0.02454 | 0.0049080 | Poor | No |
| V3.10 | 1100 | 10 | −50 | 0.00387 | 0.0003874 | Good | Yes |
| V3.11 | 1100 | 5 | −56 | 0.00181 | 0.0003611 | Good | Yes |

The invention claimed is:

1. Method for coating hot-rolled or cold-rolled steel strip containing 6-30 wt. % Mn with a metallic protective layer, wherein the steel strip to be coated is annealed at a temperature of 800-1100° C. under an annealing atmosphere containing nitrogen, water and hydrogen and is then subjected to hot dip coating, wherein in order to produce a metallic protective layer substantially free from oxidic sub-layers on the steel strip a % $H_2O$/% $H_2$ ratio of the water content % $H_2O$ to the hydrogen content % $H_2$ in the annealing atmosphere is adjusted as a function of the respective annealing temperature $T_G$ as follows:

$$\% H_2O/\% H_2 \leqq 8 \cdot 10^{-15} \cdot T_G^{3.529}.$$

2. Method according to claim 1, wherein rolling of the steel strip is carried out before hot dip coating.

3. Method according to claim 2, wherein rolling is carried out in several rolling steps and the steel strip is annealed between each rolling step.

4. Method according to claim 1, wherein annealing and hot dip coating take place in a continuous operation.

5. Method according to claim 1, wherein the metallic coating is a zinc-iron coating with a Zn-content of up to 92 wt. % and an Fe-content of up to 12 wt. %.

6. Method according to claim 1, wherein the metallic coating is an aluminum-zinc coating with an Al-content of up to 60 wt. % and a Zn-content of up to 50 wt. %.

7. Method according to claim 1, wherein the metallic coating is an aluminum-silicon coating with an Al-content of up to 92 wt. % and an Si-content of up to 12 wt. %.

8. Method according to claim 1, wherein the metallic coating is a zinc-aluminum coating, which has an Al-content of up to 10 wt. %, remainder zinc and unavoidable impurities.

9. Method according to claim 1, wherein the metallic coating is a zinc-magnesium coating, which contains up to 99.5 wt. % Zn and up to 5 wt. % Mg.

10. Method according to claim 9, wherein the zinc-magnesium coating includes up to 11 wt. % Al, up to 4 wt. % Fe and up to 2 wt. % Si.

11. Method according to claim 1, wherein the steel strip includes (in wt. %) C:≦1.6%, Mn: 6-30%, Al:≦10%, Ni:≦10%, Cr:≦10%, Si:≦8%, Cu:≦3%, Nb:≦0.6%, Ti:≦0.3%, V:≦0.3%, P:≦0.1%, B:≦0.01%, N:≦1.0%, remainder iron and unavoidable impurities.

12. Method according to claim 11, wherein the steel strip includes (in wt. %) C:≦1.00%, Mn: 20.0-30.0%, Al: ≦0.5%, Si:≦0.5%, B:≦0.01%, Ni:≦3.0%, Cr:≦10.0%, Cu:≦3.0%, N:<0.6%, Nb: <0.3%, Ti:<0.3%, V:<0.3%, P:<0.1%, remainder iron and unavoidable impurities.

13. Method according to claim 1, wherein the steel strip includes (in wt. %): C:≦1.00%, Mn: 7.00-30.00%, B:<0.01%, Ni:<8.00%, Cu:<3.00%, N:<0.60%, Nb: <0.30%, Ti:<0.30%, V:<0.30%, P:<0.01%, as well as Al : 1.00-10.00% and Si:>2.50-8.00%, where the Al-content + the Si-content is >3.50-12.00%, remainder iron and unavoidable impurities.

14. Method according to claim 1, wherein the metallic protective layer comprises zinc.

15. Method according to claim 14, wherein the metallic coating consists essentially of Zn and unavoidable impurities.

* * * * *

UNITED STATES PATENT AND TRADEMARK OFFICE

CERTIFICATE OF CORRECTION

PATENT NO. : 8,394,213 B2
APPLICATION NO. : 12/377323
DATED : March 12, 2013
INVENTOR(S) : Meurer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 373 days.

Signed and Sealed this
First Day of September, 2015

Michelle K. Lee

Michelle K. Lee
*Director of the United States Patent and Trademark Office*